US006083070A

United States Patent [19]

Watkins

[11] Patent Number: 6,083,070

[45] **Date of Patent: *Jul. 4, 2000**

[54] SACRIFICIAL SPACERS FOR LARGE AREA DISPLAYS

[75] Inventor: Charles M. Watkins, Meridian, Id.

[73] Assignee: Micron Technology, Inc., Boise, Id.

[ * ] Notice: This patent is subject to a terminal disclaimer.

[21] Appl. No.: 09/261,634

[22] Filed: Mar. 3, 1999

Related U.S. Application Data

[63] Continuation of application No. 09/016,053, Jan. 29, 1998, Pat. No. 5,962,969, which is a continuation of application No. 08/587,718, Jan. 19, 1996, Pat. No. 5,716,251, which is a continuation-in-part of application No. 08/528,761, Sep. 15, 1995, Pat. No. 5,795,206.

[51] Int. Cl.[7] ..... H01J 9/24

[52] U.S. Cl. ..... 445/24

[58] Field of Search ..... 445/24, 25; 313/495

[56] References Cited

U.S. PATENT DOCUMENTS

| | | | |
|---|---|---|---|
| 3,424,909 | 1/1969 | Rougeot | 250/207 |
| 3,979,621 | 9/1976 | Yates | 313/105 CM |
| 3,990,874 | 11/1976 | Schulman | 65/4 B |
| 4,091,305 | 5/1978 | Poley et al. | 313/220 |
| 4,183,125 | 1/1980 | Meyer et al. | 29/25.15 |
| 4,451,759 | 5/1984 | Heynisch | 313/495 |
| 4,705,205 | 11/1987 | Allen et al. | 228/180.2 |
| 4,923,421 | 5/1990 | Brodie et al. | 44/24 |
| 4,940,916 | 7/1990 | Borel et al. | 313/306 |
| 5,070,282 | 12/1991 | Epsztein | 315/383 |
| 5,136,764 | 8/1992 | Vasquez | 29/25.01 |
| 5,151,061 | 9/1992 | Sandhu | 445/24 |
| 5,205,770 | 4/1993 | Lowrey et al. | 445/24 |
| 5,229,691 | 7/1993 | Shichao et al. | 315/366 |
| 5,232,549 | 8/1993 | Cathey et al. | 456/633 |
| 5,324,602 | 6/1994 | Inada et al. | 430/23 |
| 5,329,207 | 7/1994 | Cathey et al. | 315/169.1 |
| 5,342,477 | 8/1994 | Cathey | 156/643 |
| 5,342,737 | 8/1994 | Georger, Jr. et al. | 430/324 |
| 5,347,292 | 9/1994 | Ge et al. | 345/74 |
| 5,371,433 | 12/1994 | Horne et al. | 313/495 |
| 5,374,868 | 12/1994 | Tjaden et al. | 313/310 |
| 5,391,259 | 2/1995 | Cathey et al. | 156/643 |
| 5,413,513 | 5/1995 | Horne et al. | 445/24 |
| 5,445,550 | 8/1995 | Horne et al. | 445/24 |
| 5,448,131 | 9/1995 | Taylor et al. | 313/309 |
| 5,449,970 | 9/1995 | Kumar et al. | 313/495 |
| 5,486,126 | 1/1996 | Cathey et al. | 445/25 |

FOREIGN PATENT DOCUMENTS

| | | |
|---|---|---|
| 06 904 72 A1 | 1/1996 | European Pat. Off. . |
| 2-165540 | 6/1990 | Japan . |
| 3-179630 | 5/1991 | Japan . |

*Primary Examiner*—Kenneth J. Ramsey
*Attorney, Agent, or Firm*—Hale and Dorr LLP

[57] ABSTRACT

A thin flat panel display is formed from two substrates uniformly spaced apart by a plurality of spacer members. The spacer members are formed into bundles, held together by binder material, and sliced into a plurality of thin discs. One opposing face of one of the substrates is provided with patterned arrays of first and second arrays of different adhesives. The discs are placed on the adhesives and processed to activate the adhesives, remove the binder and the second adhesive thereby reducing the number of spacers remaining in the assembly to only those adhered by the first adhesive. The second substrate is then juxtapositioned on the first substrate assembly and bonded thereto.

20 Claims, 4 Drawing Sheets

SACRIFICIAL SPACERS FOR LARGE AREA DISPLAYS

CROSS REFERENCE TO RELATED PATENT APPLICATIONS

The present patent application is a continuation of Ser. No. 09/016,053, now U.S. Pat. No. 5,962,969, which is a continuation of Ser. No. 08/587,718, now U.S. Pat. No. 5,716,251; which is a continuation-in-part of my earlier patent application Ser. No. 08/528,761 filed Sep. 15, 1995, now U.S. Pat. No. 5,795,206.

GOVERNMENT RIGHTS

This invention was made with Government support under Contract No. DABT63-93-C-0025 awarded by the Advanced Research Projects Agency (ARPA). The Government has certain rights in this invention.

BACKGROUND OF THE INVENTION

This invention relates to flat panel display devices and, more particularly, to the creation of an adequate number of spacers between the anode and cathode thereof to maintain substantially uniform spacing therebetween.

Flat field emission cathode displays typically have a cathode electron emitting surface (also referred to as a base electrode, baseplate, emitter surface, or cathode surface) and a corresponding anode display screen (also referred to as an anode, cathodoluminescent screen, display face, faceplate, or display electrode) with an evacuated cavity therebetween. There is a relatively high voltage differential (e.g., generally above 300 volts) between the cathode emitting surface and the display screen. A full description of a field emission display can be found in U.S. Pat. No. 4,940,916, the disclosure of which is incorporated herein by reference. It is important to prevent catastrophic electrical breakdown between the electron emitting surface and the anode screen by maintaining substantially uniform spacing therebetween while avoiding any structure which might contribute to arcing. At the same time, the narrow spacing between the plates and the thin structure of the plates are necessary to maintain the desired overall thinness of the FED display. The spacing also has to be substantially uniform for constant image resolution and brightness, as well as to avoid display distortion, etc.

Small area flat displays (e.g., those which are approximately 1" diagonal) generally do not require spacers, since glass having a thickness of approximately 0.0401" can support the normal atmospheric pressure load without significant bowing. However, as the display area increases, spacer supports become more important. For example, a flat display having a 10" diagonal measurement will have sufficient force exerted on it by atmospheric pressure to cause significant bowing of 0.040" thick glass. Thus spacers play an important role in maintaining the structural integrity and substantial uniform parallel spacing across large area, light weight, flat panel displays.

Spacers are incorporated between the faceplate and the cathode emitter plate. The spacers enable the thin, lightweight substrates to withstand normal atmospheric pressure thereby allowing the display area to be increased with little or no increase in either substrate thickness or overall thickness of the display.

Spacers must conform to certain parameters. The spacers must: 1) be sufficiently non-conductive to prevent catastrophic electrical breakdown between the cathode array and the anode, in spite of the relatively close inter-electrode spacing (which may be on the order of 200 $\mu$m), and relatively high inter-electrode voltage differential (which may be on the order of 300 or more volts); 2) exhibit mechanical strength such that they prevent the flat panel display from collapsing under atmospheric pressure; 3) exhibit stability under electron bombardment, since electrons will be generated at each of the pixels; 4) be capable of withstanding "bakeout" temperatures of around 400° C. that are encountered in creating the high vacuum between the faceplate and backplate of the display; and 5) be small enough in cross section so as to not to interfere with display orientation.

There are several drawbacks to the spacers currently employed in FEDs and the methods of applying them. Methods employing screen printing, stencil printing, or the like suffer from the inability to provide a spacer having a sufficiently high aspect ratio. The spacers formed by these methods can easily be either too short for the high voltages (allowing arcing) or too wide (interfering with the display image). Forming spacers by reactive ion etching and plasma etching of deposited materials suffer from slow throughput (i.e., time of fabrication), slow etch rates, and etch mask degradation. Lithographically defined photoactive organic compounds result in the formation of spacers which are not compatible with the high vacuum conditions or elevated temperature characteristics in the manufacture of field emission displays. The formation of spacers is described in U.S. Pat. Nos. 4,923,421; 5,205,770; and 5,232,549, the disclosures of which are incorporated herein by reference.

SUMMARY OF THE INVENTION

The present invention concerns a process for forming and positioning a plurality of spacers in a patterned array between the substrates of a large area, flat panel, display device in such manner as to maintain substantially uniform parallel spacing between the substrates of the device while minimizing interference with the resolution of the device. First and second patterned arrays of adhesive are applied to one substrate. Both adhesives have thermal expansion characteristics similar to those of the substrates and the spacers but the second adhesive is selectively etchable, as compared to the first adhesive. Bundles of spacers are formed with the individual spacers separated by soluble means. The bundles of spacers are sliced into discs and the discs are distributed on the surface of the one substrate which is then processed to secure the spacers to the one substrate by both adhesives. This substrate assembly is then processed to remove those spacers which are unadhered by any adhesive, as well as those adhered by the second adhesive, leaving only those spaces adhered to the one substrate by the first adhesive.

BRIEF DESCRIPTION OF THE DRAWINGS

The present invention will now be described, by way of example, with reference to the accompanying drawings, in which.

DETAILED DESCRIPTION OF AN EMBODIMENT

Figure 1:
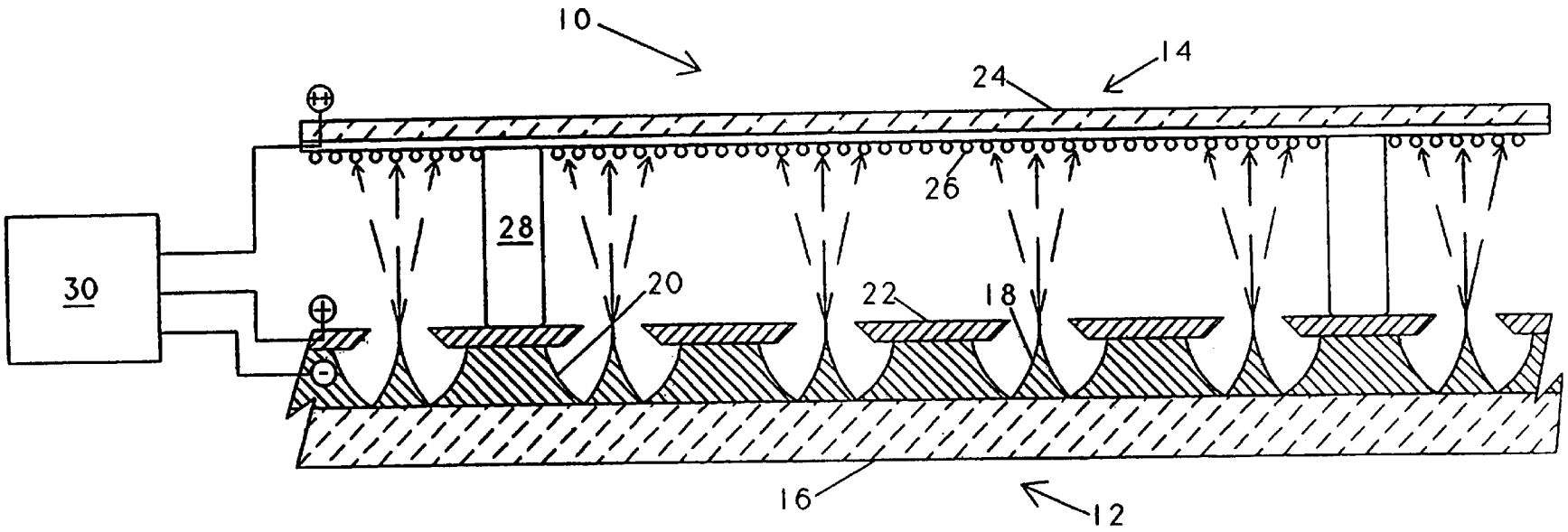
FIG. 1 is a schematic section through a representative field emission display incorporating spacers.

FIG. 1 shows a section through a representative field emission display 10 having an electron emitting cathode 12 and an anode 14. The cathode 12 has a substrate 16 with a plurality of emitter sites 18 formed thereon in spaced patterned array. The emitter sites 18 are surrounded by a dielectric layer 20 and a grid 22 overlies the dielectric layer 20 and exposes the emitter sites 18. The anode 24 is provided with a phosphor coating 26 and the substrates are spaced by a plurality of spacer members 28. The cathode 12, anode 14, and grid 22 are connected to power source 30.

Figure 2:
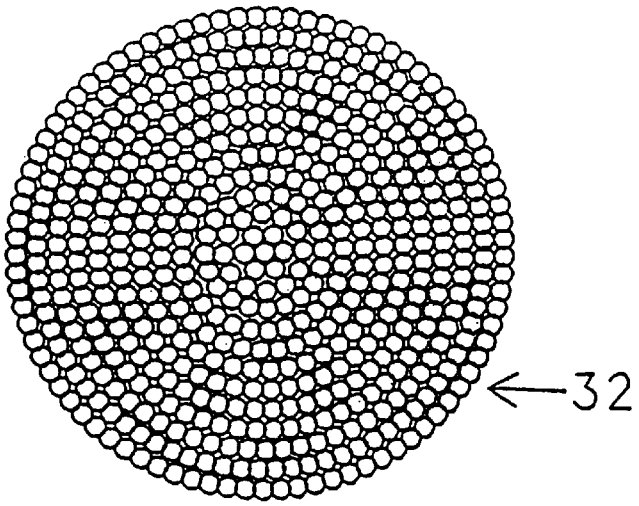
FIG. 2 is an end view of an elongated fiber bundle or cable formed in accordance with the present invention.
Figure 4:
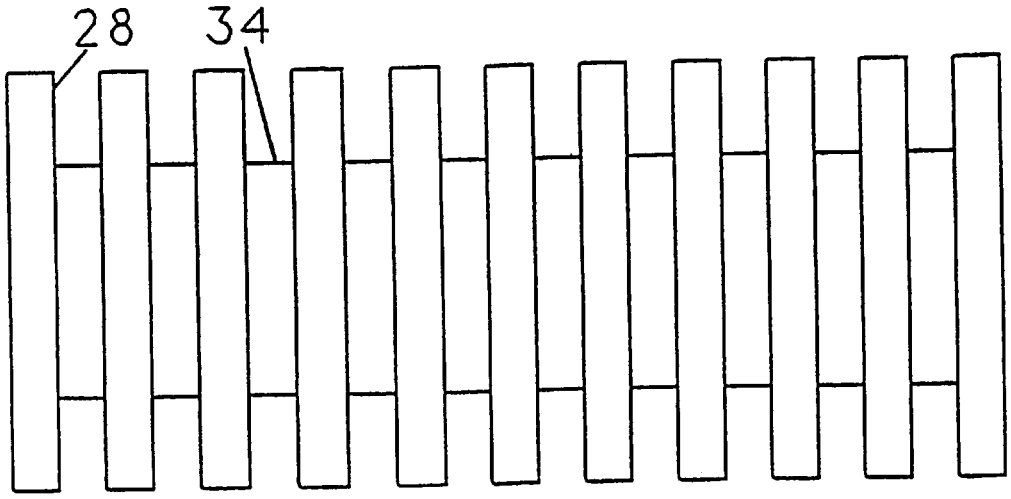
FIG. 4 is an enlarged side elevation of a portion of the disc of FIG. 3.

The spacer members 28 are initially formed in bundles 32 (FIG. 2) and held together by binder material 34 (FIG. 4). The bundles 32 are sliced into a number of discs 36. The spacer members can be formed from, for example, glass fibers 25 $\mu$m. in diameter. In one embodiment, the fibers could be made of Corning 8161 and bound together with Circon-ACMI glass Code RE695.

Since the process of the present invention is based on the use of fibers to form the spacers, it therefore lends itself to the advantageous use of coated fibers (not shown), or fibers with surfaces treated prior to forming the bundle or cable 32. A temporary coating on the fibers can be employed to provide spacing between fibers and this coating may be applied to individual fibers, prior to bundling, or simultaneously to groups or small bundles of fibers which are then incorporated into the primary bundle. The spacing between the fibers comprising the bundle can be controlled through the use of this removable coating.

The fibers may also have a permanent coating to provide very high surface resistivity. Preferably this coating is not purely insulative so that the coated fibers allow a very slight bleed off to occur over time, thereby preventing any destructive arc over. Highly resistive silicon is one example of a thin coating that is useful on the fiber.

A 6"×8" field emission display (FED) with a large ½" outer boarder between the active viewing area and the first edge has to support a compressive atmospheric pressure applied to it of approximately 910 lbs. It is worth noting that for a single 25 $\mu$m diameter, 200 $\mu$m tall quartz column, the buckle load is 0.006 lb. Excluding the bow resistance of the glass faceplate, the display would require 151,900, 25 $\mu$m×200 $\mu$m columns to avoid reaching the buckle point. With roughly one million black matrix intersections on a color display, the statistical capability of adhering that number of fibers is useful in providing a manufacturable process window.

Figure 3:
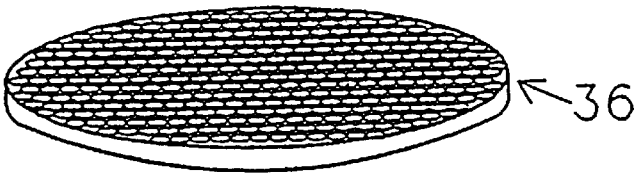
FIG. 3 is a perspective view of a slice from the bundle or cable of FIG. 2.

The above described mixed fiber bundle is sliced into a plurality of thin discs 36 (FIG. 3), each disc having a thickness of approximately 0.008" to 0.013", which is the desired separation between the substrates.

Dots of first adhesive (frit) 38 are provided at the sites where the spacers are preferably to be located. These preferred areas are in the black matrix regions as there is more room there. A pattern of a second adhesive (frit) is applied on any surface other than that covered by the first adhesive. Both adhesives have similar thermal characteristics regarding expansion and bonding between the substrate and spacer disc, but the second adhesive will be selectively etchable as compared to the first. For example, the second adhesive could be etched by Hydrochloric or Nitric acids.

Figure 5:
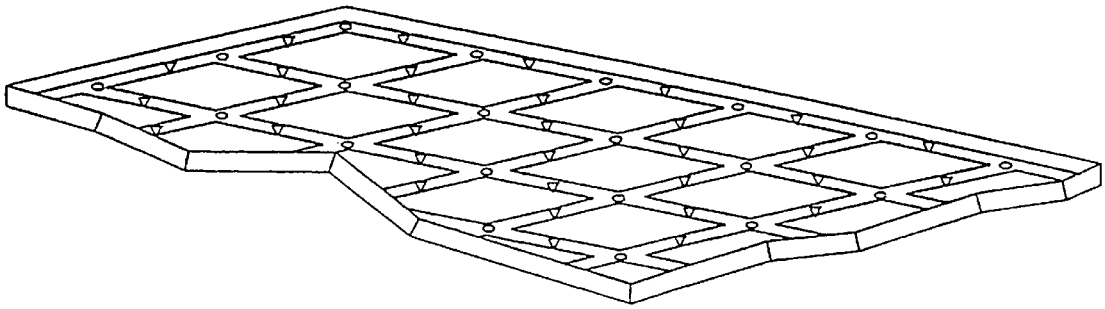
FIG. 5 is a perspective view of a segment of one of the substrates for the FED of FIG. 1 showing first frit dots in place.
Figure 6:
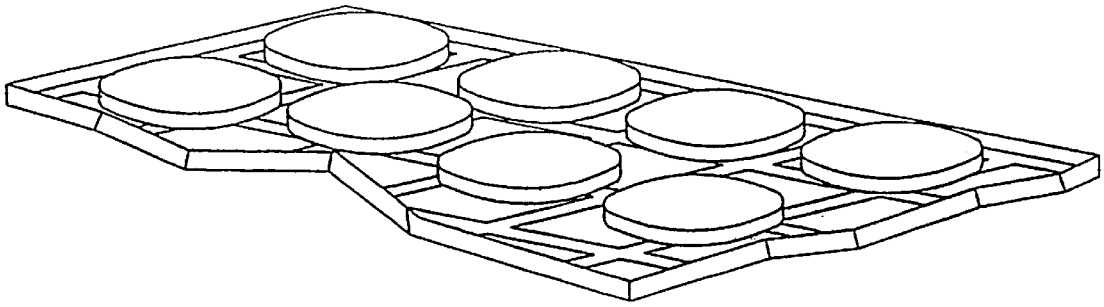
FIG. 6 is a perspective view, similar to FIG. 5 but on a different scale, with a disc of FIG. 3 in place.
Figure 7:
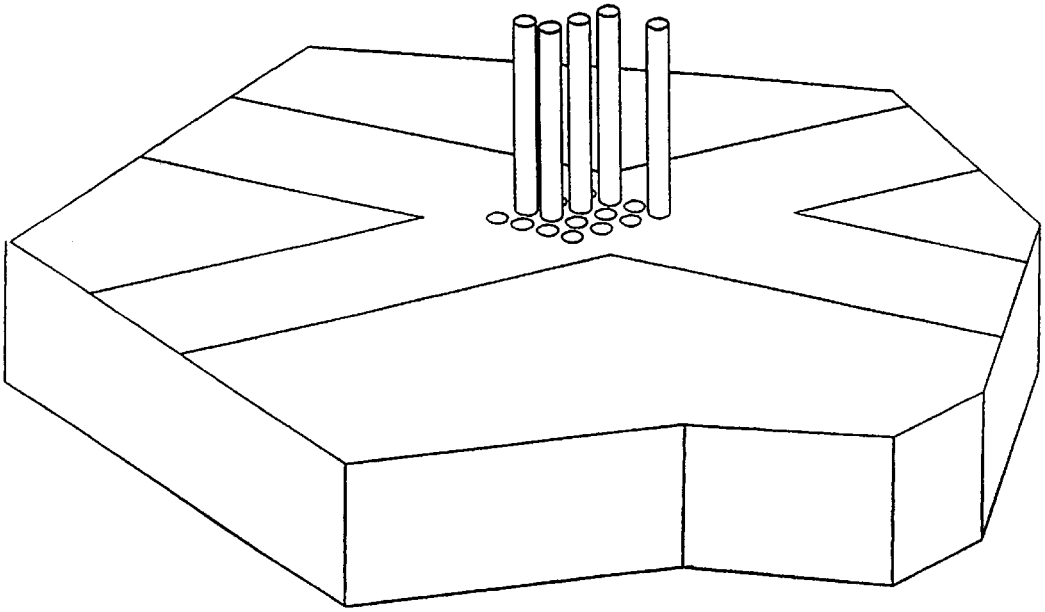
FIG. 7 is a perspective view similar to FIG. 5 but after the spacers have been adhered to the first frit dots and the rest of the disc etched away.

A screen printing system (not shown) can be used to generate the predetermined adhesion sites in thousands of locations la on the face plate and the base plate. Alternatively the adhesion sites can be lithographically defined, or formed with an XY dispense system. A substrate 16 on which first adhesive 38 is deposited is shown in FIG. 5, the sites noted by circles. These are all preferably black matrix sites, where there is no emitter or phosphor dot so as to not distort the display image in any fashion, at the matrix intersections, where there is slightly more real estate.

Depending on the deposition technique, for example, electrophoresis, improved results are achieved by forming the sacrificial adhesive layer first preventing drift onto the fiber bond adhesion sites.

One suitable material which may be used to form the adhesion sites is Corning glass code 8161. A suitable sacrificial adhesive which may be used is Corning glass code 7572. Other materials and application techniques will occur to those skilled in the art.

The substrate, with both frit patterns thereon, is heated to fuse the frit particles together. This can be accomplished by heating to a temperature of 525° C. for approximately 30 minutes. After cooling, the spacer discs can be applied and clamped or fixtured to apply force on the two components which are then heated in air to about 490° C. for about 30 minutes. When cooled, the completed assembly is etched in 10% HCl or $HNO_3$ for about 30 minutes to remove the glass cladding material, the unadhered spacers, and the sacrificial second adhesive, along with any spacers adhered thereto. The resulting substrate has high aspect spacers and is ready for the final assembly process.

There are many more adhesion sites than the final number of required spacers. Therefore the placement of the discs on the substrate does not require a high degree of placement accuracy. The number and area of the adhesion sites and spacer density in the discs are chosen to produce a reasonable yield of adhered spacers. A spacer binds to the substrate only when the fiber overlaps an adhesion site of the first adhesive.

The discs can be applied to a single substrate and then, if necessary, planarized to assure substantial uniformity of spacer height. This can be accomplished with a light polish with 500–600 grit paper without causing breakage or loss of adhesion.

Once the spacers are adhered to one substrate, they can be exposed to a solvent or chemical etchant which is selective to the glass fibers.

Then the glass fibers which did not contact a first adhesion site are also physically dislodged, when the binder between the glass fibers is dissolved, thereby leaving a distribution of high aspect ratio micro-pillars. This results in glass fibers in predetermined locations that protrude outwardly from the substrate. Preferably the spacers are disposed substantially perpendicular to the surface of the display plate.

The height of the spaces can be at least 0.005 inches (125 microns), and can be approximately 0.010 inches (250 microns), while the diameter can be in the range of 0.001 to 0.002 inches (25 to 50 microns). Thus, the height can be at least five times greater than the diameter. The adhesive materials are stable at temperatures in the range of 300° C. to 500° C. The binder used in the discs of spacers, such as a wax, is removable with a solvent including acetone.

The present invention may be subject to many modifications and changes without departing from the spirit or essential characteristics thereof. The described embodiment is therefore intended in all respects to be illustrative and not restrictive of the scope of the invention as defined by the appended claims.

We claim:

1. A method for forming a plurality of spacers between two closely spaced substrates of a flat panel display device to maintain uniform separation between the substrates, said method comprising:

providing a first group of spacers and a second group of spacers on a first substrate of a flat panel display device so that the spacers extend away from the first substrate; and removing the second group of spacers but not the first group of spacers.

2. The method according to claim 1, wherein the spacers are glass fibers.

3. The method according to claim 2, wherein the height of each spacer is greater than 125 microns.

4. The method according to claim 2, wherein the spacers are placed on the substrate disposed substantially perpendicular to the substrate, the spacers being substantially parallel to one another and having substantially uniform length.

5. The method according to claim 1, wherein the substrate is at least part of one of a baseplate and an anode screen of a field emission display.

6. The method according to claim 5, wherein the substrate is part of an anode screen that has a plurality of pixels, the spacers being adhered at locations between the pixels.

7. The method according to claim 1, wherein the spacers include ceramic.

8. The method according to claim 1, wherein the spacers include silicon.

9. The method according to claim 1, wherein the providing includes forming bundles of spacers oriented in parallel with a binding material that is removable with a solvent and providing the bundle of the substrate.

10. The method according to claim 1, wherein the providing includes providing spacers that have a height at least five times greater than a diameter.

11. The method according to claim 1, wherein the diameter of each spacer is less than 50 microns.

12. The method of claim 1, further comprising providing a second substrate to be in contact with the spacers and parallel to the first substrate, and vacuum sealing the first and second substrates so that the spacers extend from the first substrate to the second substrate across an evacuated gap.

13. A method for making a field emission display comprising:

providing first and second groups of spacers on a first substrate that is at least part of one of an anode and a cathode of a field emission display;

removing the second group of spacers; and sealing the anode and cathode to create a gap therebetween with the spacers extending from the one of an anode and a cathode of a field emission display toward the other of the anode and cathode.

14. The method of claim 13, wherein the spacers extend from the anode to the cathode.

15. The method of claim 14, wherein the spacers are cylindrical.

16. The method of claim 14, wherein the spacers are made of glass.

17. An apparatus comprising:

a substrate portion of a display device;

a first group of spacers formed on the substrate to extend away from the substrate; and a second group of spacers formed on the substrate to extend away from the substrate, the second group being formed on the substrate in a manner different from the first group of spacers and in such a manner that the second group of spacers can be removed without removing the first group.

18. The apparatus of claim 17, wherein the spacer members are cylindrical with a height at least five times greater than their diameter.

19. The apparatus of claim 17, wherein the spacer members are made of glass.

20. The apparatus of claim 17, wherein the first and second groups are each formed on the substrate with an adhesive material, wherein the adhesive for the first group is different from the adhesive for the second group.

* * * * *